US009758891B2

(12) United States Patent
Bao

(10) Patent No.: US 9,758,891 B2
(45) Date of Patent: Sep. 12, 2017

(54) LOW STRESS PROPERTY MODULATED MATERIALS AND METHODS OF THEIR PREPARATION

(75) Inventor: Zhi Liang Bao, Seattle, WA (US)

(73) Assignee: Modumetal, Inc., Seattle, WA (US)

( * ) Notice: Subject to any disclaimer, the term of this patent is extended or adjusted under 35 U.S.C. 154(b) by 685 days.

(21) Appl. No.: 13/003,283

(22) PCT Filed: Jul. 7, 2009

(86) PCT No.: PCT/US2009/049847

§ 371 (c)(1),
(2), (4) Date: Jan. 24, 2012

(87) PCT Pub. No.: WO2010/005993

PCT Pub. Date: Jan. 14, 2010

(65) Prior Publication Data

US 2012/0118745 A1 May 17, 2012

Related U.S. Application Data

(60) Provisional application No. 61/078,668, filed on Jul. 7, 2008.

(51) Int. Cl.

| | |
|---|---|
| ***C25D 3/66*** | (2006.01) |
| ***C25D 5/18*** | (2006.01) |
| ***C25D 5/10*** | (2006.01) |
| ***C25D 5/16*** | (2006.01) |
| ***C25D 3/20*** | (2006.01) |
| ***C25D 17/10*** | (2006.01) |

(52) U.S. Cl.

CPC ..... *C25D 5/10* (2013.01); *C25D 3/20* (2013.01); *C25D 3/665* (2013.01); *C25D 5/16* (2013.01); *C25D 5/18* (2013.01); *C25D 17/10* (2013.01)

(58) Field of Classification Search

CPC ..... C25D 5/18; C25D 5/16
USPC ..... 205/103
See application file for complete search history.

(56) References Cited

U.S. PATENT DOCUMENTS

| | | | | |
|---|---|---|---|---|
| 2,470,775 | A * | 5/1949 | Jernstedt et al. | 205/103 |
| 2,678,909 | A * | 5/1954 | Jernstedt et al. | 205/103 |
| 3,716,464 | A | 2/1973 | Kovac | |
| 4,666,567 | A | 5/1987 | Loch | |

(Continued)

FOREIGN PATENT DOCUMENTS

| | | | |
|---|---|---|---|
| WO | WO 9700980 | | 1/1997 |
| WO | WO 2007021980 | A2 * | 2/2007 |
| WO | WO 2007082112 | | 2/2007 |

OTHER PUBLICATIONS

Zabludovsky V A et al: "The Obtaining of Cobalt Multilayers by Programme-Controlled Pulse Current", Transactions of the Institute of Metal Finishing, Maney Publishing, Birmingham, GB, vol. 75, No. 05, Sep. 1, 1997 (Sep. 1, 1997 ), p. 203/204.

(Continued)

*Primary Examiner* — Brian W Cohen
(74) *Attorney, Agent, or Firm* — Seed IP Law Group LLP

(57) ABSTRACT

The technology described herein sets forth methods of making low stress or stress free coatings and articles using electrodeposition without the use of stress reducing agents in the deposition process. The articles and coatings can be layered or nanolayered wherein in the microstructure/nanostructure and composition of individual layers can be independently modulated.

43 Claims, 2 Drawing Sheets

(56) References Cited

U.S. PATENT DOCUMENTS

| | | | | |
|---|---|---|---|---|
| 4,869,971 | A | 9/1989 | Nee | |
| 5,326,454 | A * | 7/1994 | Engelhaupt | C25D 5/10 205/103 |
| 2,706,170 | A | 1/1995 | Marchese | |
| 6,071,398 | A * | 6/2000 | Martin et al. | 205/103 |
| 6,537,683 | B1 | 3/2003 | Staschko | |
| 2006/0272949 | A1 | 12/2006 | Detor | |
| 2007/0158204 | A1 * | 7/2007 | Taylor | C25D 3/30 205/300 |
| 2009/0130425 | A1 | 5/2009 | Whitaker | |
| 2009/0283410 | A1 * | 11/2009 | Sklar et al. | 205/103 |

OTHER PUBLICATIONS

Weil R et al: "Pulsed electrodeposition of layered brass structures", Metallurgical and Materials Transactions A: Physical Metallurgy & Materials Science, ASM International, Materials Park, OH, US, vol. 19, No. 6, Jun. 1, 1988 (Jun. 1, 1988), pp. 1569-1573.

Ross C A: "Electrodeposited multilayer thin films", Annual Review of Materials Science, Annual Reviews Inc., Palo Alto, CA, US, vol. 24, Jan. 1, 1994 (Jan. 1, 1994), pp. 159-188.

International Preliminary Report on Patentability issued on Oct. 18, 2011, in International Patent Application No. PCT/US2009/049832.

International Search Report issued on Sep. 30, 2011 in International Patent Application No. PCT/US2009/049832.

International Preliminary Report on Patentability issued on Nov. 1, 2011, in International Patent Application No. PCT/US2009/049847.

International Search Report issued on May 27, 2010, in International Patent Application No. PCT/US2009/049847.

Marchese V J: "Stress Reduction of Electrodeposited Nickel", Journal of the Electrochemical Society, vol. 99, No. 2, (Feb. 1, 1952), pp. 39-43.

* cited by examiner

LOW STRESS PROPERTY MODULATED MATERIALS AND METHODS OF THEIR PREPARATION

RELATED APPLICATIONS

This application is a 35 U.S.C. §371 application of International Application No. PCT/US2009/049847, filed Jul. 7, 2009, which claims the benefit of priority to U.S. Provisional Patent Application No. 61/078,668, filed Jul. 7, 2008, each of which is incorporated by reference in its entirety.

BACKGROUND

Stress Free Material Using Control of Electrodepositing Process

One difficulty with the preparation of coatings articles produced by electrodeposition processes arises from the internal stress in the electrodeposited materials that can lead to the failure of coatings and articles. A variety of means have been used to reduce the stress in electrodeposited materials including the use of stress reducing agents such as saccharin in nickel plating, and thiourea for copper plating. The ability to electrodeposited materials, and particularly metals, in stress free or low stress form without the use of additives that can negatively impact the performance of electrodeposited materials could provide an advance to the material science of electroplating and electroforming of coatings and articles.

SUMMARY OF THE DISCLOSURE

This disclosure provides electrodeposition processes for the application of low stress or stress free coatings and the preparation of low stress or stress free articles. The low stress and stress free coatings and electroformed articles may be prepared as a single material that is unlayered, or as an electroformed coating or article that is comprised of layered or nanolayered metal(s) or metal alloy(s) without the use of additives for the reduction of stress.

In one embodiment the technology described herein is directed to a method of applying a low stress or stress free coating to substrate, or of electroforming a low stress or stress free article using electrodeposition comprising the steps of: applying an electrical current to said substrate, said current having a time varying current density, wherein the current density is controlled as a function of time, said function of time comprised of two or more cycles wherein each cycle independently has a first time period and a second time period. In this embodiment the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1.

In another embodiment the technology described herein is directed to a method of applying a low stress or stress free coating to substrate, or of electroforming a low stress or stress free article using electrodeposition comprising the steps of:

(a) providing a bath including one or more electrodepositable species;

(b) providing a substrate to be coated;

(c) at least partially immersing the substrate in the bath, the substrate being in electrical communication with a power supply; and (d) applying an electrical current to said substrate, said current having a time varying current density. In this embodiment the current density is controlled as a function of time, and the function of time is comprised of two or more cycles wherein each cycle independently has a first time period and a second time period, where the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period is greater than 1.

Embodiments described herein also provide coatings and articles comprising stress free or low stress materials electrodeposited without the use of stress reducing additives by the methods described herein.

BRIEF DESCRIPTION OF THE DRAWINGS

The drawings are not necessarily to scale; emphasis is being placed upon illustrating the principals of the disclosure.

DETAILED DESCRIPTION

Figure 1:
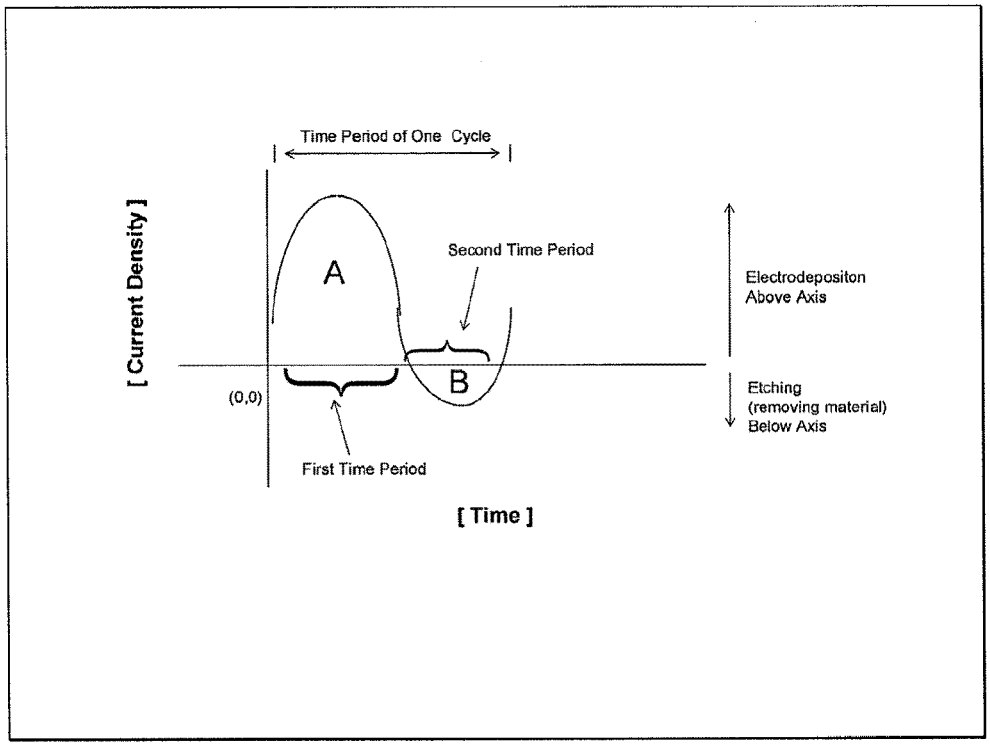
FIG. 1 illustrates one cycle of a generic function used to control the current density in the electrodeposition of low stress or stress free coatings or electroform low stress or stress free articles. The figure indicates the area bounded by the function and a line representing zero current density for said first period by the "A" and the area bounded by the function and a line representing zero current density for said second period by "B," which are used to determine the ratio $\beta^A$.

Materials deposited by electrodeposition must have low stress to avoid cracking or peeling in the plating process or subsequent use. Moreover if the electrodeposited materials contain thin or narrow features, then the stress must be tensile as compressive stress would likely result in buckling of the material. A good deal of stress is intrinsic to the plating process, and some systems such as Ag and Fe—Ni are notorious for their high stress. See e.g., Marc J. Maldou "*LIGA and Micromolding*" Chapter 4, The MEMS Handbook, 2$^{nd}$ edition, CRC Press, Edited by Mohamed Gad-el-Hak (2006). While it is possible to relieve stress from electrodeposited materials by using stress reducing agents during their deposition, such agents not only add to the cost of final product, perhaps more importantly they can affect the performance and properties of the deposited materials.

The processes described herein provide, among other things, an electrodeposition process that produces low stress coatings without the use of stress reducing agents. Embodiments of the processes described herein may be used to electroform articles where the process employs a mandrel as a substrate that can be separated from the electrodeposited materials. The processes may also be used to form a coating on a substrate that is comprised of a single layer of low stress or stress free electrodeposited material and in some embodiments, the process can be used to form multiple layers or graded layers of electrodeposited materials, one or more of which are layers of low stress or stress free electrodeposited materials.

Stress in a coating or layer may refer to the tendency of a material to curl or deform, causing it to peel away from the substrate onto which it is deposited. Tensile and compressive stresses in a coating or layer result in concave and convex delamination, respectively. Stress in an electrodeposited coating or article may be evaluated by any suitable means in the known in the art. For purposes of this disclosure, low stress coatings and articles are those that can maintain contact with a rigid substrate during electrodeposition when the bond strength is less than 400 MPa, or, more preferably less than 350 MPa, 300 MPa, 250 MPa, 200 MPa, 150 MPa, 100 MPa, 60 MPa, 40 MPa, 30 MPa, 20 MPa, or 10 MPa. For the purposes of this disclosure stress free means that the coating or article has a level of stress that is at, or below, the level of measurement, and which does not affect the ability of the article to maintain contact with the substrate during electrodeposition.

The stress of an electrodeposited material also may be characterized using conventional methods such as the bent strip method and commercially available testing equipment such a Model 683 deposit stress analyzer, available from Specialty Testing and Development Co., Pa. For purposes of this disclosure, low stress coatings, layers, and articles have less than 400 MPa, or, more preferably less than 350 MPa, 300 MPa, 250 MPa, 200 MPa, 150 MPa, 100 MPa, 80 MPa, 60 MPa, 40 MPa, 30 MPa, 20 MPa, or 10 MPa of stress as assessed by the bent strip method. For the purposes of this disclosure, where a bent strip test is employed as means of assessing stress, "stress free" means that the coating, layer or article has a level of stress that is at, or below, the level of measurement in the bent strip test.

For the purposes of this disclosure, "electrodeposition" defines a process in which electricity drives formation of a deposit on an electrode (e.g., a substrate) at least partially submerged in a bath including a component or species, which forms a solid phase upon either oxidation or reduction. The terms electrodeposition or electrodeposited include both electrolytic deposition (e.g., reduction of metal ions to metals) and electrophoretic deposition.

For the purposes of this disclosure, "electrodepositable species" define the constituents of a material deposited using electrodeposition. Electrodeposited species include, without limitation, metal ions forming a metal salt. Particles which are deposited in a metal matrix formed by electrodeposition, polymers and metal oxides can also be electrodeposited. Organic molecules (e.g., citric acid, malic acid, acetic acid, and succinic acid) may also be co-deposited with other electrodepositable species.

For the purpose of this disclosure, current density is the current (generally in amperes) per unit area of a substrate upon which material is to be electrodeposited. Where current densities are stated to be positive, they are cathodic (reducing) currents and negative current densities are anodic (oxidizing) currents.

For the purpose of this disclosure, the average current density for an electrodeposition process is taken as the integral of the current density versus time curve describing the process, divided by the total time and has the units of charge per unit area per unit time. Average current density can be calculated for one or more cycles of the function used to control current density in the electrodeposition processes described herein.

For the purpose of this disclosure, nanolayered means layered material having at least one layer with at least one dimension (usually thickness) greater than 0.5 nm and less than 1,000 nm.

For the purpose of this disclosure, an electrolyte can be an aqueous solution or an ionic liquid, either of which may comprise one or more electrodepositable species.

In one embodiment a method of producing low stress or stress free coatings on a substrate, or of electroforming an article on a substrate (e.g., a mandrel) using electrodeposition comprises:

applying an electrical current to said substrate, said current having a time varying current density, wherein the current density is controlled as a function of time, said function of time comprised of two or more cycles wherein each cycle independently has a first time period and a second time period, where the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1.

In another embodiment a method of producing low stress or stress free coating to substrate, or of electroforming an article on a substrate (e.g., a mandrel) using electrodeposition comprises:

(a) providing a bath including one or more electrodepositable species;

(b) providing a substrate to be coated;

(c) at least partially immersing the substrate in the bath, the substrate being in electrically communication with a power supply; and (d) applying an electrical current to said substrate, said current having a time varying current density, wherein the current density is controlled as a function of time, said function of time comprised of two or more cycles wherein each cycle independently has a first time period and a second time period, and where the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1.

While the description provided in FIG. 1 is not to be viewed as limiting the type of functions that may be employed to produce low stress or stress free coatings and articles by electrodeposition, that figure illustrates exemplary functions that may be employed to produce low stress or stress free materials through electrodeposition. The embodiments described above may be better understood by reference to that figure.

As positive current density is defined as a reducing cathodic current for the purposes of this disclosure, ratio $\beta^A$ (Beta based on the integrated areas) must be greater than 1 for a cycle in order for there to be a net deposition of reducible materials (e.g. metal cations) at the cathode in the methods forming low or stress free coatings and articles described herein.

The value of $\beta^A$ may effectively be any value greater than 1 and less than infinity for any cycle of the of the method but more typically $\beta^A$ will be between a value that is greater than 1 and less than 100, or greater than 1.001 and less than 100, or greater than 1.01 and less than 100, or greater than 1.05 and less than 100, or greater than 1.1 and less than 100. In some embodiments the value of $\beta^A$ is greater than a value selected from 2, 4, 8, 10, 20, 50, 100, 200, 400, 800, 1,000, or 10,000; in such embodiments the value of $\beta^A$ may be limited by an upper value of 100,000. In other embodiments the value of the ratio $\beta^A$ may have a value greater than 1, or 1.01, or 1.05 or 1.1 and less than a value independently selected from 1.2, 1.25, 1.3, 1.35, 1.4, 1.45, 1.5, 1.6, 1.7, 1.8, 1.9, 2, 2.2, 2.4, 2.6, 2.8, 3.0, 3.5, 4, 6, 8, 10, 15, 20, 25, 50, 100, 200, 400, 800, 1,000, or 10,000. In some embodiments the value of $\beta^A$ within a range selected from: 1.01 to 2, 1.01 to 1.7, 1.01 to 1.6, 1.01 to 1.5, 1.01 to 1.4, 1.01 to 1.3, 1.01 to 1.2, 1.1 to 1.5, 1.1 to 1.6, 1.1 to 1.7, 1.1 to 1.8, 1.3 to 1.5, 1.3 to 1.7, 1.3 to 1.9, 1.5 to 1.7, 1.5 to 1.8, 1.5 to 1.9, 1.5 to 2.0, 1.6 to 1.9, 1.6 to 2, 1.7 to 1.9, 1.8 to 2, 1.5 to 8, 1.5 to 6, 2 to 40, 2 to 20, 2 to 10, 4 to 40, 1.1 to 50, or 2 to 50.

The number of cycles, each of which includes first period of electrodeposition and a second period of oxidation (etching or dissolution), used to apply a coating or to prepare an article using the methods described herein depends upon the thickness of the desired coating or article and the characteristics of the cycle employed (e.g., total passed charge and $\beta^A$ which represents the ratio of the material deposited to the material removed in a cycle). In some embodiments the function used in the electrodeposition process has 3 or more cycles, 10 or more cycles, 50 or more cycles, 100 or more cycles, 200 or more cycles, 500 or more cycles, 1,000 or more cycles, 2,000 or more cycles, 5,000 or more cycles, 10,000 or more cycles, 20,000 or more cycles, 50,000 or more cycles, 100,000 or more cycles, 200,000 or more cycles, 400,000 or more cycles, 500,000 or more cycles, 750,000 or more cycles, or 1,000,000 or more cycles.

While current density is controlled as a function of time in the electrodeposition processes described herein, the function for the individual cycle need not, but can, be the same. In some embodiments the function is identical for each cycle (although other parameters including the temperature and plating bath composition can be varied). In other embodiments the same function may be applied for one cycle or over a series of consecutive cycle followed by the application of a different function (with or without a change in the other parameters). In some embodiments the function applied for the low stress or stress free electrodeposition process is identical for 2, 3, 4, 5, 10, 20, 50, 100, 250, 500, 1,000, 5,000, 10,000, 20,000, 50,000, 100,000, 200,000, 500,000 consecutive cycles and the other plating parameters are also held constant (do not change). In other embodiments, the function applied for the low stress or stress free electrodeposition process is identical for 2, 3, 4, 5, 10, 20, 50, 100, 250, 500, 1,000, 5,000, 10,000, 20,000, 50,000, 100,000, 200,000, 500,000 consecutive cycles and one or more, or two or more, or three or more plating parameters (e.g., plating temperature, bath composition, or the concentration of the electrodepositable species in the bath) varied for one or more of the cycles.

In another embodiment the function employed for the electrodeposition processes described herein has 2, 3, 4, 5, 7, 10, 15, 20, 25, 50, 100, 200, 500, or 1,000 consecutive cycles wherein the function is employed in the electrodeposition process is not identical for those consecutive cycles. In one variation the function is varied between a first function and a second function for alternate cycles. In another variation the function is varied from a first function to second function to a third function over three consecutive cycles.

In some embodiments the value of the ratio $\beta^A$ can be varied. In such embodiments, $\beta^A$ may be varied for 2, 3, 4, 5, 10, 20, 50, 100, 250, 500, 1,000, 5,000, 10,000, 20,000, 50,000, 100,000, 200,000, 500,000 or more consecutive cycles. In those embodiments where $\beta^A$ is increased or decreased from a first value to a second value by incrementally changing $\beta^A$, the disclosed methods may be used to create coatings or articles that vary from a first property or composition to a second property or composition in a continuous fashion (e.g., graded materials).

The functions describing the change in current density with respect to time for a cycle of electrodeposition may be of virtually any form. In some embodiments the function is one that has a discontinuous first derivative with respect to time. Such functions include square wave, rectangular wave, triangular wave, or saw tooth wave forms possessing a DC offset. In other embodiments the function describing the change in current density with respect to time may have a continuous first order derivative. In other embodiments such functions may have a continuous first order derivative with respect to time. Functions with continuous first order derivatives include shifted sine wave, shifted cosine wave, and other periodic wave type functions possessing a DC offset.

Figure 2:
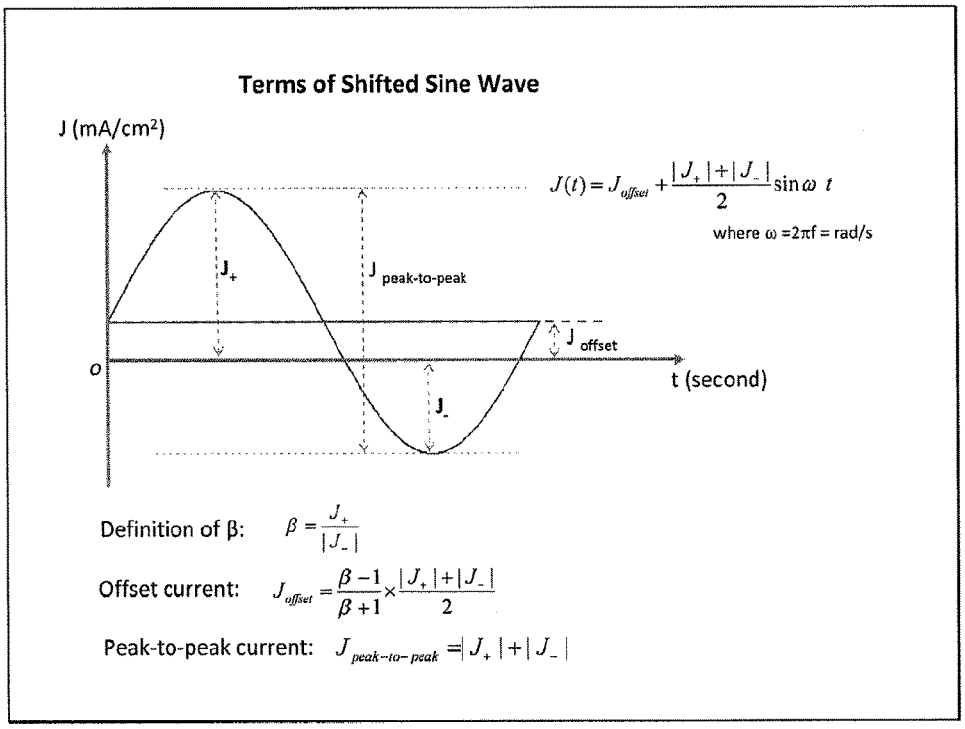
FIG. 2 Illustrates an alternative set of terminology that may be used to describe the generic function used to control the current density in the plating process, particularly where the function used is a sine wave function. Positive values of J (current density) are cathodic and reducing, whereas negative values are anodic and oxidizing. For net electrodeposition to take place with a sine wave function the value of $\beta$ must be greater than one (i.e. $J_{offset}$ must be greater than zero).

Shifted sine wave functions, which are a special case of the general wave forms used to control the current density, may be described using three parameters, the offset current density, the frequency and the peak to peak current density used for the plating process. See FIG. 2, which describes the terms that can be used with a "shifted sine wave" that has been shifted vertically on the current density axis by the application of an offset current density. For shifted sine wave functions a value $\beta$, which is the ratio of the peak cathodic current density to the absolute value of the peak anodic current density may be defined. See FIG. 2 and associated text.

Where shifted sine or shifted cosine wave forms are used they are offset such that ratio $\beta^A$ or $\beta$ will be greater than 1, resulting in net electrodeposition of material at the cathode. In other embodiments the sine or cosine waves may be modified such that the amplitudes for the wave forms in the range of 0° to 180° and the range 180° to 360° degrees is different, resulting in a $\beta^A$ that is greater than one.

In some embodiments wave forms other than shifted sine waves and square (rectangular) waves with DC offsets may be employed, and part or all of any method described herein may be conducted provided that the wave form utilized is not a sine wave or a square (rectangular) wave with a DC offset. Hence, any of the methods of this disclosure may be carried out with the proviso that when current density is controlled as a function of time, the function is not a sine wave or a square or rectangular wave form.

The length of time for each cycle of the electrodeposition processes described herein may be the same or different, with the length of time varying independently for each cycle. In some embodiments the function describing the deposition process may have 1 to 4,000, 1 to 2,000, 1 to 800, 1 to 400, 1 to 200, 1 to 100, 1 to 10, 2 to 50, 3 to 75, 10 to 200, 50 to 300, or 100 to 400 cycles per second (Hz). In general, the frequency of the wave form (e.g., sine wave, square wave, or triangular wave) will vary from about 0.01 to about 1,000 Hz, with ranges typically being from about 10 to about 400 Hz.

The peak anodic and cathodic currents, which are the maximum currents applied to a substrate during the periods of electrodeposition and oxidation (etching) during each cycle of the functions used to control current density, may also be modulated. Generally the absolute value of peak cathodic and anodic currents can be independently varied from about 1 to about 2,000 $mA/cm^2$, with typical ranges being from about 10 to about 300 $mA/cm^2$ or from about 60 to about 100 $mA/cm^2$.

The methods of electrodepositing low stress or stress free coating or electroforming articles may be used with a broad variety of electrodepositable species. In some embodiments the bath used for electrodeposition may contain only one electrodepositable species. In some embodiments where the bath contains only one electrodepositable species the electrodepositable species is selected from the group consisting of: nickel, iron, cobalt, copper, zinc, manganese, platinum, palladium, rhodium, iridium, gold, aluminum, magnesium, and silver. In some embodiments where the bath contains only one electrodepositable species the electrodepositable species is selected from the group consisting of: nickel, cobalt, copper, zinc, manganese, platinum, palladium, rhodium, iridium, gold, aluminum, magnesium, and silver. In other embodiments where the electrolyte bath contains only one electrodepositable species the electrodepositable species is selected from the group consisting of: nickel, cobalt, manganese, platinum, palladium, rhodium, iridium, and silver. In still other embodiments where the bath contains only one electrodepositable species the electrodepositable species is selected from the group consisting of: nickel, cobalt, copper, zinc, manganese, gold, and silver.

In still other embodiments, the methods of electrodepositing low stress or stress free materials may be practiced with the proviso that the electrodepositable species is not iron when the bath (electrolyte) contains only one electrodepositable species of metal; in such embodiments the bath (electrolyte) may further not include stress reducing agents (e.g., thiourea or saccharin).

In some embodiments the electrolyte bath (electrolyte) used for electrodeposition may contain two or more, or three or more, or four or more electrodepositable species. In some embodiments where the bath (electrolyte) contains two or more, or three or more, or four or more electrodepositable species, at least one electrodepositable species is selected from the group consisting of: molybdenum, tungsten, nickel, iron, cobalt, copper, zinc, manganese, platinum, palladium, rhodium, iridium, gold, aluminum, magnesium, and silver. In other embodiments at least one electrodepositable species is selected from the group consisting of: molybdenum and tungsten. In embodiments, where the bath (electrolyte) for electrodeposition contains two or more, or three or more, or four or more electrodepositable species, the methods of electrodepositing low stress or stress free materials may be practiced with the proviso that the electrodepositable species is not iron.

In some embodiments the material to be deposited is an alloy comprising nickel having greater than about 60% 70%, 75% 80%, 85% 90% or 95% of the electrodeposited material as nickel on a weight basis. In other embodiments the material to be deposited will be an alloy comprising nickel and iron having greater than about 55%, 60%, 70%, 75% 80%, 85% 90% or 95% of the electrodeposited material as the iron with the remainder made up of either nickel, or nickel and up to 5% other metals on a weight basis.

In another embodiment the material to be deposited is an alloy comprising chromium, iron, and optionally nickel. In such alloys the chromium is present as 11-25% of the electrodeposited material, nickel is present from 0-20% of the electrodeposited materials, with the remainder made up of either iron, or iron and up to 5% other metals on a weight basis.

In still another embodiment the material to be deposited is an alloy comprising copper and zinc. In such alloys the copper is present at 1-95% of the electrodeposited material, preferably between 50% and 80%, with the remainder made up of either zinc, or zinc and up to 10% other metals on a weight basis.

In still another embodiment the material to be deposited is an alloy comprising copper and tin. In such alloys the copper is present at 1-95% of the electrodeposited material, preferably 11% to 13%, with the remainder made up of either tin, or tin and up to 10% other metals on a weight basis.

In yet another embodiment the material to be deposited is an alloy comprising copper and aluminum. In such alloys the copper is present at 1-25% of the electrodeposited material, with the remainder made up of either aluminum, or aluminum and up to 10% other metals (such as magnesium) on a weight basis.

In one embodiment chromium may be electrodeposited alone or as an alloy wherein chromium comprises greater than 50% of the electrodeposited material on a weight basis. In methods of electrodepositing chromium the chromium may be electrodeposited from either a $Cr^{+3}$ or $Cr^{+6}$ salt.

One embodiment provide for the electrodeposition of chromium as an alloy with iron, wherein the chromium comprises 1%-75% of the electrodeposited material on a weight basis with the remainder made up of either iron, or iron and up to 10% other metals on a weight basis. In such an embodiment the chromium may be electrodeposited from a $Cr^{+3}$ salt.

In still other embodiments, the material to be electrodeposited is an alloy comprising a metal selected from molybdenum, tungsten, nickel, iron, cobalt, copper, zinc, manganese, platinum, palladium, rhodium, iridium, gold, aluminum, magnesium, and silver; wherein greater than about 40%, 50% 60% 70%, 75% 80%, 85%, 90%, or 95% of the electrodeposited alloy is comprised of the selected metal.

Other embodiments provide for the electrodepositing of iron with an organic molecule (e.g., citric acid, malic acid, acetic acid, or succinic acid). In such embodiments the organic molecule may comprise up to 2% of the total weight of the deposited material with the remainder made up of either iron, or iron and up to 10% other metals on a weight basis.

In some embodiments where the system (electrolyte) contains one or more electrodepositable species, those species may be the same electrodepositable species for the entirety of electrodeposition processes (the same species for all cycles). In other embodiments where the system contains one or more electrodepositable species, the composition of the bath used for electrodeposition may be changed so that different species or mixtures of electrodepositable species are present for different portions of the electrodeposition processes (i.e., to form a material that is compositionally modulated throughout its growth direction).

In addition to varying composition of the electroplating media (bath), a variety of electrodeposition parameters can be modulated while still electrodepositing low stress or stress coatings or electroforming low stress or stress free articles. In some embodiments one or more of the electrodeposition parameters that can be modulated in one or more independently selected cycles, (whether those cycles are consecutive or not) are selected from: peak positive current density; the length of time of said first time period; the peak negative current density; the length of time of said second time period, the average current density, electrodeposition temperature (temperature of the bath) or the composition of the electrodeposition media (e.g., electrodeposition bath) may be. In other embodiments, one or more, or two or more, parameters selected from: the peak positive current density; the length of time of said first time period; the peak negative current density; the length of time of said second time period, or the average current density may be modulated in one or more, or two or more, independently selected cycles. In still other embodiments, one or more, or two or more, parameters selected from the temperature of the electrodeposition media (bath) or the composition of said the bath may be modulated in one or more, or two or more, independently selected cycles.

Embodiments of the methods described herein may be employed to produce low stress or stress free coatings and articles that may consist of one layer (material having a single type of structure and composition) in addition to coatings and articles that are layered or nanolayered. Layers and nanolayers present in the coatings and articles described herein need not arise from single cycles of the function used to control the electrodeposition process, instead, layers or nanolayers may arise from the application of numerous cycles of a function used to control electrodeposition. Thus, in some embodiments, the methods described herein may be used to develop layered or nanolayered coatings and articles by utilizing different wave forms in combinations. For example, a single composition may be deposited as a low stress or stress free layer utilizing numerous cycles of a sine wave function, followed by the deposition of a next layer of the same composition utilizing numerous cycles of a saw tooth wave form. Alternatively, low stress or stress free layers may be built up by the application of numerous cycles of specific function describing the electrodeposition of a first composition followed by the use numerous cycles of the same function to apply a layer of different composition or a layer of the same composition at a different temperature.

Embodiments of the methods described herein are particularly useful as they permit the electrodeposition and electroforming of low stress or stress free coatings and articles without the use of stress reducing agent; however, where desirable it is possible to use the methods describe above in combination standard electrodeposition process that either do not control stress or use stress reducing agents. Thus, in addition to the deposition of layers of a substance (e.g., a metal) using low stress or stress free electrodeposition as described herein, it is possible to deposit layers of low stress or stress free materials utilizing stress reducing agents or by standard electrodeposition (e.g., DC electroplating). In some instances, such as where control of defect propagation or the direction of corrosive decomposition of coatings is desired, it may be desirable to prepare layered or nanolayered materials that have repeating (e.g., alternating) layers of: stress free and low stress materials; low stress or stress free materials alternated with layers of uncontrolled stress materials; or layers of stress free, low stress and uncontrolled stress materials.

A variety of substrates for electrodeposition may be employed in the methods described herein. While the substrate may comprise a solid, conductive material (such as a metal object to be coated), other substrates are also possible. For example, instead of being solid, the substrate may be formed of a porous material, such as a consolidated porous substrate, such as a foam, a mesh, or a fabric. Alternatively, the substrate can be formed of an unconsolidated material, such as, a bed of particles, or a plurality of unconnected fibers. In some embodiments, including for example, embodiments which utilize electrodeposition, the substrate is generally formed from a conductive material or a nonconductive material which is made conductive by metallizing. In other embodiments, the substrate may be a semiconductive material, such as a silicon wafer, or a nonconductive material, such as a ceramic or plastic composite. Where it is desirable to prepare an article through the use of electroforming, a solid conductive mandrel that can be separated from the electroformed materials may be employed (i.e., titanium or stainless steel mandrel).

The electrodeposition methods described herein may be used without etching substrates prior to the application of low stress coatings without the use of additives in the electrodeposition process (e.g., the bath) to relieve stress. The methods of coating a substrate described herein may be utilized without the use of etching by electrical current, that is to say the application of a net negative (anodic current) to the substrate prior to (or immediately prior to) the application of a low stress coating. Similarly, the methods of coating a substrate described herein may be utilized without the use of etching by chemical means prior to (or immediately prior to) the application of a low stress coating without the use of additive to relieve stress.

Some embodiments of this present disclosure are directed to a coating or article produced by the methods of electrodepositing low stress or stress free materials described herein that do not require the use of stress reliving agents. In some embodiments, a coating or article comprises a single low stress or stress free layer of electrodeposited materials that has not been deposited using stress reducing agents.

In other embodiments, a low stress or stress free coating or article of the present technology comprises: a first material having a first composition and defined by one or more of a first composition, a first average grain size, a first grain boundary geometry, a first crystal orientation, and a first defect density; and a second material having a second composition and a second nanostructure defined by one or more of a second composition, a second average grain size, a second grain boundary geometry, a second crystal orientation, and a second defect density. In still another embodiment, a low stress or stress free coating comprises: a first material having a first composition and a first nanostructure defined by one or more of a first composition, a first average grain size, a first grain boundary geometry, a first crystal orientation, and a first defect density; and a second material having a second composition and a second nanostructure defined by one or more of a second composition, a second average grain size, a second grain boundary geometry, a second crystal orientation, and a second defect density; with the proviso that the second composition is the same as the first composition while one of the first average grain size differs from the second average grain size, the first grain boundary geometry differs from the second grain boundary geometry, the first crystal orientation differs from the second crystal orientation, and the first defect density differs from the second defect density.

In some embodiments, property modulated coatings and articles are provided comprising a plurality of alternating layers, in which one or more of those layers are low stress or stress free layers that have specific mechanical properties, such as, for example, tensile strength, elongation, hardness, ductility, and impact toughness, and where the specific mechanical properties are achieved by altering the nanostructure of those layers. Examples of such are provided in Examples 1 and 2.

In general, tensile strength may be controlled through controlling frequency of a signal used for electrodepositing a material. In general, percentage of elongation of a material can also be controlled through frequency. In general, hardness, ductility, and impact toughness can be controlled through controlling deposition temperature. Other methods for controlling tensile strength, elongation, hardness, ductility and impact toughness are also envisioned.

The structure of low stress and stress free electrodeposited materials may also be controlled in order to produce materials with desired properties. Smaller grain sizes, which can range, e.g., from about 0.5 nanometers to about 100 nanometers, generally will yield layers that exhibit high impact toughness. Large grain sizes, which generally will be greater than 1,000 nanometers, such as, for example, 5,000 or 10,000 nanometers, will generally produce layers that provide greater ductility. Of course, the grain sizes will be relative within a given group of layers such that even a grain size in the intermediate or small ranges described above could be deemed large compared to, e.g., a very small grain size or small compared to a very large grain size.

Generally, such grain sizes can be controlled through process parameters, such as, for example deposition temperature (e.g., electrodeposition bath temperature). To modulate grain size utilizing temperature control, a first layer defined by large grains can be formed by increasing the deposition temperature and a second layer defined by smaller grains can be formed by decreasing the temperature.

The thickness of the individual layers in the coatings and articles can range from about 0.1 nanometer to about 10,000 nanometers or more. Layer thickness may range from about 5 nanometers to 50 nanometers, although varied thicknesses are expressly envisioned. Coatings and articles prepared by the methods described herein may contain a single layer or any number of desired layers, including a number of layers within a range selected from: 2-10, 10-20, 20-30, 30-50, 50-100, 2-500, 100-500, 2-1,000, 500-1,000, 1,000-5,000 5,000-10,000, or 2-10,000 or even more layers. Each layer may be independently created with a desired composition, thickness, and nanostructure/microstructure and with each layer being independently chosen to be of a low stress or stress free nature.

The coatings and articles described herein may be used separately or as part of other coatings and articles and may be incorporated into laminated structures. In addition, the methods of preparing low stress or stress free coatings and articles utilizing the electrodeposition methods described herein, may be used in conjunction with other methods of preparing low stress or stress free coatings and articles. Such methods include the use of chemical deposition such as electroless (auto-catalytic) deposition or plating, chemical vapor deposition, or physical vapor deposition. Such processes may be advantageous where it is difficult to electrodeposit specific metals such as aluminum, titanium, and magnesium.

EXAMPLES

The following examples are merely intended to illustrate the practice and advantages of specific embodiments of this disclosure; and are not intended in any way to limit or illustrate any limits of the methods, articles or embodiments described herein.

Example 1: Low Stress Electrodeposition of Iron

Deposition of iron layers in a low stress or stress free form may be accomplished using an offset sine wave to control current density in the electrodeposition process. The beta value is defined as the ratio of peak cathodic to peak anodic current densities; alternately, $\beta^A$ is defined as the ratio cathodic charge density (integral of the cathodic portion of j(t) with respect to time) to the anodic charge density (integral of the anodic portion of j(t) with respect to time). At low beta value (<1.8), the electroplated iron layers have low hardness and high ductility.

The electroplating system includes a tank, electrolyte of $FeCl_2$ bath with or without $CaCl_2$, computer controlled heater to maintain bath temperature, a power supply, and a controlling computer. The anode is low carbon steel sheet, and cathode is titanium plate which will make it easy for the deposit to be peeled off Carbon steel can also be used as the cathode if the deposit does not need to be peeled off from the substrate. Polypropylene balls are used to cover the bath surface in order to reduce bath evaporation.

The process for producing an iron laminate is as follows:

1. Prepare a tank of electrolyte consisting of 2.0 M $FeCl_2$ plus 1.7 $CaCl_2$ M in deionized water.
2. Adjust the pH of the electrolyte to −0.5-1.5 by addition of HCl.
3. Control the bath temperature at 60° C.
4. Clean the titanium substrate cathode and low carbon steel sheet anode with deionized water and immerse both of them into the bath.
5. To start electroplating a high ductility layer, turn on the power supply, and controlling the power supply to generate a shifted sine wave with a beta of 1.26 ($\beta^A$=1.50) by setting the following parameters: 250 Hz with a peak cathodic current density of 43 mA/cm$^2$, and a peak anodic current density of −34 mA/cm$^2$ applied to the substrate (i.e., a peak to peak current of 78 mA/cm$^2$ with a DC offset of 4.4 mA/cm$^2$). Continue electroplating for an amount of time necessary to achieve the desired high ductility layer thickness.
6. Remove the substrate and deposit from the bath and immerse in DI water for 10 minutes and blow it dry with compressed air.
7. Peel the deposit from the underlying titanium substrate to yield a free-standing low stress iron sheet.

Example 2: Electrodeposition of Low Stress High Elongation Nickel-Iron Alloy Low stress or stress free Ni—Fe alloys can be electrodeposited using a shifted sine wave with a defined β value (see FIG. 2 and associated text). At low beta values (<1.3), the electroplated iron-nickel alloy layers have low hardness, low stress, larger grain size, and high elongation, while at high beta (>1.5), the plated iron-nickel alloy layers have higher hardness, smaller grain size and lower elongation. At beta value of (<1.25), the deposited Ni—Fe alloy film's stress is almost zero, which makes it possible to obtain low stress and ductile Ni—Fe alloy deposits without sulfur co-deposition caused by adding stress reducing additives such as saccharin. The low stress Fe—Ni deposit makes it possible to deposit very thick layers. It is also possible to deposit onto semiconductors and low adhesion substrates such as conductively coated non-conductive mandrels. Because no sulfur containing additives are used, it is possible for these Ni—Fe alloy deposits to be used at high temperature environments without brittleness caused by co-deposited sulfur.

For electrodeposition of Ni—Fe alloys the system includes a tank, an electrolyte of a mixture of $FeCl_2$ and $NiCl_2$, a computer controlled heater to maintain bath temperature, a power supply, and a controlling computer. The anode is an Ni—Fe alloy plate. Any conductive material can be used as the cathode, however, where titanium is used as the cathode, the deposit can be removed from its surface. Carbon steel can be used as the cathode if the deposit does not need to be removed from the substrate. Polypropylene balls are used to cover the bath surface in order to reduce bath evaporation. Electrodeposition of the Ni—Fe laminate is conducted as follows:

1. A tank (bath) of electrolyte consisting of a mixture of 1.0 M $FeCl_2$ and 1.0 M $NiCl_2$ in deionized water is prepared.
2. The pH of the electrolyte is adjusted to 0.8 by addition of HCl.
3. The bath temperature is maintained at 50° C.
4. The substrate cathode (metals, alloys, semiconductors, or conductively coated non-conductive mandrels) and the Fe—Ni alloy anode are cleaned with deionized water and immersed in the electrolyte bath.
5. Electroplating of a low stress, high ductility layer is started by providing power to the electroplating power supply, and controlling the power supply to generate a shifted sine wave with a β value of 1.25 by setting the following parameters: 250 Hz with a peak-to-peak current density of 60 mA/cm$^2$, a DC offset current density 3.3 mA/cm$^2$. Electroplating is continued for an amount of time necessary to achieve the desired thickness.
6. The substrate bearing the electrodeposited Fe—Ni alloy is removed from the bath and immerse in deionized water for 10 minutes and blown dry with compressed air.
7. The electrodeposited Ni—Fe alloy is removed by peeling it from the underlying substrate to yield a free-standing nickel-iron film. Alternatively, the deposited nickel-iron alloy may be left as a deposit on the substrate.

Example 3: Electrodeposition of Low Stress Ni Films Using Shifted Sine Wave

Electrodeposition of nickel films may be accomplished using a shifted sine wave similar to that employed in Example 2. At low beta values (<1.3) electroplated nickel films have low hardness, low stress, larger grain size, and high elongation, while at high beta (>1.5), the plated nickel films have higher hardness, smaller grain size and lower elongation. At beta value of (<1.25), deposited Ni films have almost zero stress, which makes it possible to obtain low stress and ductile Ni deposits without sulfur co-deposition from stress reducing additives such as saccharin. The low stress of Ni deposit electrodeposited using the embodiments disclosed herein makes it possible to deposit very thick layers. By controlling the wave form used to deposit nickel in a low stress or stress free format, it is also possible to electrodeposite nickel onto low adhesion substrates such as conductively coated non-conductive mandrels. Because no sulfur containing additives are used, it is possible for these Ni deposits to be used in high temperature environments without becoming brittle due to co-deposited sulfur.

For electrodeposition of nickel the system includes a tank, an electrolyte of $NiCl_2$, a computer controlled heater to maintain bath temperature, a power supply, and a controlling computer. The anode is a nickel plate. Any conductive material can be used as the cathode. However, where titanium is used as the cathode, the deposit can be removed from its surface. Carbon steel can be used as the cathode if the deposit does not need to be removed from the substrate. Polypropylene balls are used to cover the bath surface in order to reduce bath evaporation.

The process for producing an iron deposit is as follows:

1. A tank (bath) of electrolyte consisting of a mixture of 1.0 M $NiCl_2$ in deionized water is prepared.
2. The pH of the electrolyte is adjusted to 0.8 by addition of HCl.
3. The bath temperature is maintained at 50° C.
4. The substrate cathode (metals, alloys, semiconductors, or conductively coated non-conductive mandrels) and the nickel anode are cleaned with deionized water and immersed in the electrolyte bath.
5. Electroplating of a low stress, high ductility layer is started by providing power to the electroplating power supply, and controlling the power supply to generate a shifted sine wave with a β value of 1.25 by setting the following parameters: 250 Hz with a peak-to-peak current density of 60 mA/cm$^2$, a DC offset current density 3.3 mA/cm$^2$. Electroplating is continued for an amount of time necessary to achieve the desired thickness.
6. The substrate bearing the electrodeposited nickel is removed from the bath and immersed in deionized water for 10 minutes and blown dry with compressed air.
7. The electrodeposited nickel is removed by peeling it from the underlying substrate to yield a free-standing nickel film. Alternatively, the deposited nickel may be left as a deposit on the substrate.

The invention claimed is:

1. A method of applying a low stress coating to a substrate, or of electroforming a low stress article, using electrodeposition comprising:

forming a low stress coating or low stress electroformed article having a stress less than 400 MPa by applying an electrical current to said substrate, said current having a time varying current density wherein the current density is controlled as a function of time;

wherein said function of time is comprised of four or more cycles, wherein each cycle independently has a first time period and a second time period, and wherein said function has a continuous first derivative with respect to time;

where the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1, and the value of β, which is the peak cathodic current divided by the absolute value of the peak anodic current, is greater than 1;

with the proviso that the time varying current density is a sine wave function having a D.C. offset current for four or more cycles wherein said sine wave function has a continuous first order derivative and wherein said sine wave function is symmetric about said D.C. offset current; wherein $\beta^A$ is varied for four or more consecutive cycles; and wherein the coating or electroformed article is comprised of two or more nanolayers each having a thickness greater than 0.5 nm and less than 1,000 nm.

2. The method of claim 1, wherein, prior to applying the electrical current to said substrate, the method further comprises the steps of:

(a) providing a bath including one or more electrodepositable species;

(b) providing a substrate to be coated; and (c) at least partially immersing the substrate in the bath, the substrate being in electrical communication with a power supply.

3. The method of claim 1, wherein the ratio $\beta^A$ has a value greater than 1 and less than 1.2.

4. The method of claim 1, wherein said sine wave function has 200 or more cycles.

5. The method of claim 1, wherein said sine wave function is not identical for any five consecutive cycles.

6. The method of claim 1, wherein $\beta^A$ is varied for 10 or more consecutive cycles.

7. The method of claim 1, wherein said sine wave function has from 1 to 4,000 cycles per second.

8. The method of claim 2, wherein said bath comprises one or more electrodepositable species selected from the group consisting of: nickel, cobalt, copper, zinc, manganese, platinum, palladium, rhodium, iridium, gold, aluminum, magnesium, and silver.

9. The method of claim 1, further comprising independently modulating for four or more of said cycles:

(a) one or more parameters selected from: the peak positive current density; the length of time of said first time period; the peak negative current density; the length of time of said second time period, or the average current density; and (b) one or more parameters selected from: the temperature of said bath or the composition of said bath.

10. The method of claim 1, wherein the substrate is not etched prior to the application of a coating, and is not subject to chemical etching, etching by alternating current (AC), or etching by direct current (DC) prior to, or immediately prior to, the application of a layer of the coating having a stress less than 400 MPa.

11. The method of claim 1, wherein the stress is less than 250 MPa.

12. The method of claim 1 wherein $\beta$ is greater than 1 and less than 1.25.

13. The method of claim 1 wherein $\beta$ is greater than 1 and less than 1.3.

14. The method of claim 1 wherein $\beta$ is greater than 1 and less than 1.8.

15. The method of claim 7, wherein said function has 50 to 300 or 100 to 400 cycles per second.

16. The method of claim 6, wherein $\beta$ is greater than 1 and less than 1.8.

17. The method of claim 1, wherein said time varying current has a peak-to-peak current value up to 60 mA/cm$^2$.

18. A method of applying a low stress coating to a substrate, or of electroforming a low stress article, using electrodeposition comprising:

forming a low stress coating or low stress electroformed article having a stress less than 400 MPa by applying an electrical current to said substrate to cause the electrodeposition of a composition comprising a single metal, said current having a time varying current density;

wherein the current density is controlled as a function of time, and said function of time is comprised of three or more cycles, wherein each cycle independently has a first time period and a second time period, and wherein said function has a continuous first derivative with respect to time;

wherein the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1;

wherein the value of $\beta$, which is the peak cathodic current divided by the absolute value of the peak anodic current, is greater than 1; wherein $\beta^A$ is varied for three or more consecutive cycles; and wherein the coating or electroformed article is comprised of two or more nanolayers each having a thickness greater than 0.5 nm and less than 1,000 nm.

19. The method of claim 18, wherein, prior to applying the electrical current to said substrate, the method further comprises the steps of:

a. providing a bath including one electrodepositable metal species;

b. providing a substrate to be coated; and c. at least partially immersing the substrate in the bath, the substrate being in electrical communication with a power supply.

20. The method of claim 18, wherein the ratio $\beta^A$ has a value greater than 1 and less than 1.2.

21. The method of claim 18, wherein said function has 200 or more cycles.

22. The method of claim 18, wherein said function is not identical for any two consecutive cycles.

23. The method of claim 18, wherein $\beta^A$ is varied for five or more consecutive cycles.

24. The method of claim 18, wherein said function is a sine wave that is symmetric about a D.C. offset current.

25. The method of claim 18, wherein said function has 1 to 4,000 cycles per second.

26. The method of claim 19, wherein said bath comprises an electrodepositable species selected from the group consisting of: nickel, cobalt, copper, zinc, manganese, platinum, palladium, rhodium, iridium, gold, aluminum, magnesium, and silver.

27. The method of claim 18, further comprising independently modulating for three or more of said cycles:

a. one or more parameters selected from: the peak positive current density; the length of time of said first time period; the peak negative current density; the length of time of said second time period, or the average current density; and b. one or more parameters selected from: the temperature of said bath or the composition of said bath.

28. The method of claim 18, wherein the substrate is not etched prior to the application of a coating, and is not subject to chemical etching, etching by alternating current (AC), or etching by direct current (DC) prior to, or immediately prior to, the application of a layer of low stress or stress free coating.

29. The method of claim 18, wherein the stress is less than 250 MPa.

30. The method of claim 18 wherein β is greater than 1 and less than 1.8.

31. The method of claim 25, wherein said function has 50 to 300 or 100 to 400 cycles per second.

32. The method of claim 24, wherein β is greater than 1 and less than 1.8.

33. The method of claim 1 wherein each individual layer of the two or more layers has a thickness between about 5 nanometer to about 50 nm and wherein each individual layer varies in at least one of: nanostructure, microstructure, or stress.

34. The method of claim 18 wherein the coating or electroformed article has a stress less than 200 MPa.

35. The method of claim 18 wherein each individual layer of the two or more layers has a thickness between about 5 nanometer to about 50 nm.

36. The method of claim 18 wherein each individual layer of the two or more layers independently varies in one or more of: thickness, nanostructure, microstructure, or stress.

37. A method of applying a low stress coating to a substrate, or of electroforming a low stress article, using electrodeposition comprising:

(a) providing a bath including one or more electrodepositable species;

(b) providing a substrate or mandrel to be coated;

(c) at least partially immersing the substrate or mandrel in the bath, the substrate or mandrel being in electrical communication with a power supply; and (d) forming a low stress coating on the substrate or low stress electroformed article on the mandrel having a stress less than 400 MPa by applying an electrical current to said substrate, said current having a time varying current density wherein the current density is controlled as a function of time;

wherein said function of time is comprised of three or more cycles, wherein each cycle independently has a first time period and a second time period, and wherein said function has a continuous first derivative with respect to time;

where the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1;

wherein $\beta^A$ is varied for 3 or more consecutive cycles;

wherein the value of β, which is the peak cathodic current divided by the absolute value of the peak anodic current, is greater than 1;

with the proviso that the time varying current density is a sine wave function having a D.C. offset current for three or more cycles wherein said sine wave function has a continuous first order derivative and wherein said sine wave function is symmetric about said D.C. offset current; and wherein the coating or electroformed article is comprised of two or more nanolayers each having a thickness greater than 0.5 nm and less than 1,000 nm.

38. A method of applying a low stress coating to a substrate, or of electroforming a low stress article, using electrodeposition comprising:

forming a low stress coating or low stress electroformed article having a stress less than 400 MPa by applying an electrical current to said substrate;

wherein the current density is controlled as a function of time, and said function of time is comprised of four or more cycles, wherein each cycle independently has a first time period and a second time period, and wherein said function has a continuous first derivative with respect to time;

wherein the value of said current density during said first time period is greater than zero, and the value of the current density during said second time period is less than zero, provided that the ratio, $\beta^A$, which is defined as the ratio of the area bounded by the function and a line representing zero current density for said first period divided by the absolute value of the area bounded by the function and a line representing zero current density for said second period, is greater than 1;

wherein the function is not identical for four or more consecutive cycles;

wherein the value of β, which is the peak cathodic current divided by the absolute value of the peak anodic current, is greater than 1; and wherein the coating or electroformed article is comprised of two or more nanolayers each having a thickness greater than 0.5 nm and less than 1,000 nm.

39. The method of claim 37, wherein said bath comprises one or more electrodepositable species selected from the group consisting of: nickel, cobalt, copper, zinc, manganese, and silver.

40. The method of claim 37, wherein the bath comprises an ionic liquid.

41. The method of claim 40, wherein the electrodepositable species comprises one or more of manganese, aluminum and magnesium.

42. The method of claim 41, wherein the electrodepositable species comprises aluminum.

43. The method of claim 19, wherein the electrodepositable species is not iron.

* * * * *